US007414202B2

(12) United States Patent
Lee et al.

(10) Patent No.: US 7,414,202 B2
(45) Date of Patent: Aug. 19, 2008

(54) INSULATED ELECTRIC WIRE WITH PARTIAL DISCHARGE RESISTANCE AND COMPOSITION FOR MANUFACTURING THE SAME

(75) Inventors: Joon-Hee Lee, Gyeonggi-do (KR); Ki-Hong Park, Gyeonggi-do (KR)

(73) Assignee: LS Cable Ltd., Seoul (KR)

( * ) Notice: Subject to any disclaimer, the term of this patent is extended or adjusted under 35 U.S.C. 154(b) by 0 days.

(21) Appl. No.: 11/703,117

(22) Filed: Feb. 5, 2007

(65) Prior Publication Data

US 2007/0181334 A1 Aug. 9, 2007

(30) Foreign Application Priority Data

Feb. 6, 2006 (KR) ..... 10-2006-0011119

(51) Int. Cl.
*H01B 7/00* (2006.01)

(52) U.S. Cl. ..... 174/120 R

(58) Field of Classification Search ..... 174/110 R, 174/110 SR, 120 R

See application file for complete search history.

(56) References Cited

U.S. PATENT DOCUMENTS 4,539,342 A * 9/1985 Lee et al. ..... 521/189
4,544,696 A * 10/1985 Streusand et al. ..... 524/428
5,153,274 A * 10/1992 Kinloch et al. ..... 525/422
6,180,888 B1 * 1/2001 Yin et al. ..... 174/110 R

FOREIGN PATENT DOCUMENTS

JP 2005-112908 4/2005

* cited by examiner

*Primary Examiner*—Chau N Nguyen
(74) *Attorney, Agent, or Firm*—Jones Day

(57) ABSTRACT

Disclosed are an insulated electric wire with partial discharge resistance and a composition for manufacturing the same. The insulated electric wire with partial discharge resistance according to the present invention includes an insulating base resin constituting a basic material of an insulated electric wire; an inorganic insulator included at a content of 5 to 40 parts by weight on the basis of 100 parts by weight of the insulating base resin; and a rubbery modifier included at a content of 0.1 to 30 parts by weight on the basis of 100 parts by weight of the insulating base resin to improve flexibility of an insulated electric wire. The insulated electric wire with partial discharge resistance of the present invention may be useful to prevent occurrence of cracks caused by winding of an insulated electric wire since the insulated electric wire has a sufficient partial discharge resistance and also enhances sufficient physical properties such as flexibility, pliability, bendability, elongation, etc. to maintain an electrically insulating property intactly by dispersing a stress, applied from an external force, by means of a rubber component attached to an end thereof.

8 Claims, 1 Drawing Sheet

INSULATED ELECTRIC WIRE WITH PARTIAL DISCHARGE RESISTANCE AND COMPOSITION FOR MANUFACTURING THE SAME

BACKGROUND OF THE INVENTION

1. Field of the invention

The present invention relates to an insulated electric wire with partial discharge resistance and a composition for manufacturing the same, and more particularly to an insulated electric wire with partial discharge resistance including a rubbery modifier in an insulating base resin, the rubbery modifier being capable of improving flexibility of an inorganic insulator and an insulated electric wire, and a composition for manufacturing the same.

2. Description of the Related Art

In a deterioration mechanism for partially discharging an electrical insulator such as coating materials for an electric wire, charging particles generated by a partial discharge may collide with an insulator, high molecular weight chains in the insulator may be broken by the collision, and thermal decomposition may be initiated due to local increase of temperature. Also, chemical deterioration of the insulator may be caused by ozone generated by the partial discharge. It has been known that the partial discharge caused by usage of electrical and electronic appliances, or various deterioration factors derived from other factors combinationally act to raise various barriers to essential functions of the electric insulator. Meanwhile, it has been known that deterioration by partial discharge generated in an inverter controller widely used in recent years is caused by a switch pulse generated by a high voltage surge, which eventually deteriorates coils in the inverter controller.

Accordingly, U.S. Pat. Nos. 4,493,873, 6,100,474, etc. propose an improvement of materials constituting an insulator to prevent or reduce deterioration of the electric insulator by partial discharge. That is to say, U.S. Pat. No. 4,493,873 proposes an inorganic insulator such as oxides or nitrides of inorganic materials, glass, mica and the like as an insulator which is not easily deteriorated by partial discharge, and U.S. Pat. No. 6,100,474 proposes a method for mixing a mixture of silica ($SiO_2$) and chromium oxide with a resin, coating an insulated electric wire with the resultant mixture and reductively calcining the mixture. Meanwhile, it has been known that, regardless of the inorganic insulator and the method as described above, an insulated electric wire having an excellent partial discharge deterioration-resistance is manufactured by applying an insulating paint compound prepared by dispersing fine particles of an inorganic insulator such as silica, alumina ($Al_2O_3$), titania ($TiO_2$), etc.

The partial discharge resistance may be improved as the content of the fine particles of inorganic insulator increases among insulators in the insulated electric wire. However, an insulated electric wire, made of an insulated film containing a large amount of the fine particles of the inorganic insulator, also has a disadvantage that its physical properties such as flexibility, pliability, bendability, elongation, etc. may be deteriorated. As described above, if an electrical coil was formed of the insulated electric wire having the deteriorated physical properties such as flexibility, pliability, bendability, elongation, etc., crack occurrence is increased upon coating the insulated electric wire, and therefore the partial discharge resistance of the insulated electric wire is not sufficiently improved due to the crack occurrence.

In order to solve the above-mentioned problems, there has been recently proposed a method for manufacturing an insulated electric wire having a multi-layered structure. The insulated electric wire having the multi-layered structure may be adopted for different purposes in separate layers. That is to say, an insulation layer dispersed with the inorganic insulator has been adopted to improve partial discharge deterioration, and other insulation layers have been adopted to improve physical properties such as flexibility, pliability, bendability, elongation, etc. However, in the case of the insulated electric wires having the multi-layered structure, a thick wire having a diameter of at least 1.5 mm still has a problem that cracks occur in an abruptly bent region of an insulated film upon winding. As an alternative to solve the problem, Japanese Patent No. 496633 proposes a technique for improving flexibility by dispersing a solution of nano-sized inorganic oxide in a solvent to prepare a colloid sol, and mixing the colloid sol with an insulating paint, and U.S. Pat. No. 6,734,361 proposes a method for improving flexibility by chemically combining silica with a resin itself. However, it is difficult to completely solve the above problems of the thick wire having a diameter of at least 1.5 mm by means of the conventional methods.

Accordingly, there have been ardent and steady attempts to develop an insulated electric wire with partial discharge resistance while exhibiting a sufficient pliability even in a thick wire having a diameter of at least 1.5 mm in the related art, and therefore the present invention was designed based on the above technical background.

SUMMARY OF THE INVENTION

The present invention is designed to solve the problems of the prior art, and therefore it is an object of the present invention to provide an insulated electric wire with partial discharge resistance capable of improving physical properties such as flexibility, pliability, etc., which are deteriorated due to a large amount of an inorganic insulator, and maintaining a sufficient flexibility even in a thick wire having a predetermined diameter by enhancing a dispersing effect on an external force, and a composition for manufacturing the same.

In order to accomplish the above object, the present invention provides a composition for manufacturing an insulated electric wire with partial discharge resistance including an insulating base resin constituting a basic material of an insulated electric wire; an inorganic insulator included at a content of 5 to 40 parts by weight on the basis of 100 parts by weight of the insulating base resin; and a rubbery modifier included at a content of 0.1 to 30 parts by weight on the basis of 100 parts by weight of the insulating base resin to improve flexibility of an insulated electric wire.

An insulation effect obtained by adding the inorganic insulator may not be sufficiently accomplished if the content of the inorganic insulator is less than the lower numerical limit, while the partial discharge resistance may be enhanced but other physical properties, for example flexibility, pliability, bendability, elongation, etc., may be deteriorated if the content exceeds the upper numerical limit.

An effect on the addition of the rubbery modifier may not be accomplished due to a small amount of the added rubbery modifier if the content of the rubbery modifier is less than the lower numerical limit, while functional problems of the insulated electric wire may be caused since a mechanical property of the insulated electric wire is deteriorated and works may not be progressed since a viscosity increases upon preparing an insulation paint if the content exceeds the upper numerical limit.

The insulating base resin is preferably a single material or copolymer thereof, or a mixture of at least two materials selected from the group consisting of polyester, polyesterimide, polyamideimide and polyimide.

The inorganic insulator is preferably metal oxide or metal nitride having a diameter of 5 to 900 nm. The metal oxide selected as the inorganic insulator is preferably a single material or a mixture of at least two materials selected from the group consisting of silicone (Si), titanium (Ti), zirconium (Zr) and cobalt (Co), and the metal nitride selected as the inorganic insulator is preferably a single material or a mixture of at least two materials selected from the group consisting of silicone (Si), titanium (Ti), zirconium (Zr) and cobalt (Co). An effect of the inorganic insulator on pliability of the insulated electric wire is hardly improved if the diameter of the inorganic insulator is less than the lower numerical limit, and if the diameter exceeds the upper numerical limit, an effect of the inorganic insulator on pliability of the insulated electric wire is not improved when compared to an amount of the added inorganic insulator, and therefore an addition effect of the inorganic insulator is declined.

The rubbery modifier is preferably a single material or a mixture of at least two materials selected from the group consisting of a CTB rubber (carboxyl-terminated butadiene rubber), an ATBN rubber (amino-terminated butadieneacrylonitrile rubber) and copolymers thereof.

In order to accomplish the above objects, the insulated electric wire with partial discharge resistance provided in the present invention is manufactured with the above-mentioned composition, wherein the insulated electric wire preferably has a diameter of at least 1.0 mm, but the present invention is not limited to the numerical range.

BRIEF DESCRIPTION OF THE DRAWINGS

Other objects and aspects of the present invention will become apparent from the following description of embodiments with reference to the accompanying drawings. However, it should be understood that the description proposed herein is just a preferable example for the purpose of illustrations only, not intended to limit the scope of the invention. In the drawings.

DESCRIPTION OF THE PREFERRED EMBODIMENT

Figure 1:
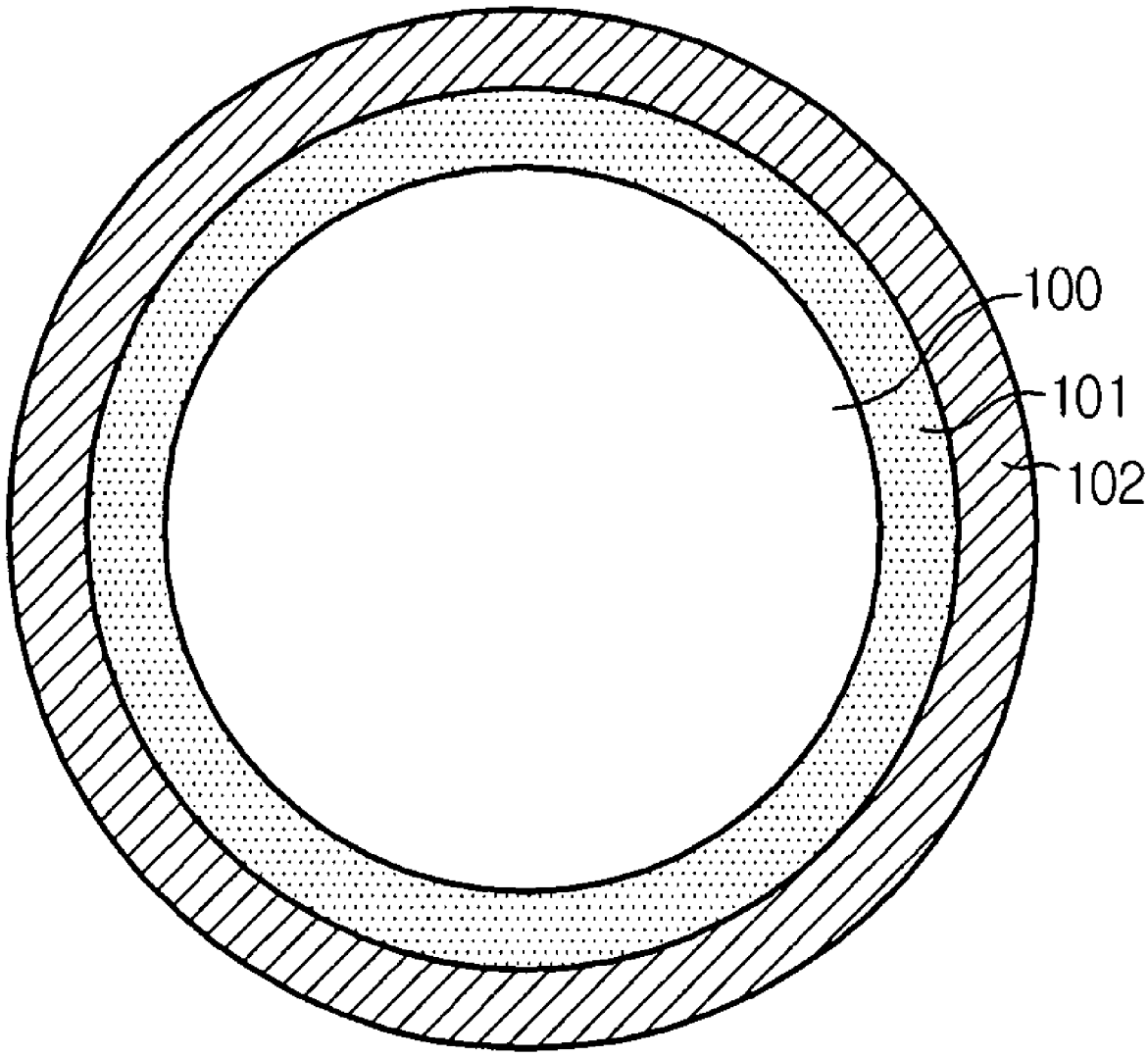
FIG. 1 is a cross-sectional view showing an insulated electric wire according to one embodiment of the present invention.

Hereinafter, preferred embodiments of the present invention will be described in detail referring to the accompanying drawings. However, the description proposed herein is just a preferable example for the purpose of illustrations only, not intended to limit the scope of the invention, so it should be understood that other equivalents and modifications could be made thereto without departing from the spirit and scope of the invention. The preferred embodiments of the present invention will be described in detail for the purpose of better understandings, as apparent to those skilled in the art.

It might be seen that, if a stress is subject to the insulation film manufactured by adding and dispersing inorganic oxides or nitrides or by binding the inorganic oxides or nitrides to molecular chain ends, the stress is focused on the inorganic matters in the insulator used for the insulated electric wire with partial discharge resistance. Accordingly, there has been proposed a method in which materials containing small particle sizes of the inorganic oxides or nitrides are used to facilitate the easy stress dispersion. However, it was seen that cracks might occur from the inorganic oxides or nitrides since a stress does not completely disappear through the stress dispersion.

Accordingly, the insulated electric wire with partial discharge resistance according to the present invention was manufactured by dispersing a predetermined inorganic insulator, which has a diameter of less than a micrometer (μm), in an insulating base resin solution so as to improve a flexibility of the insulated electric wire. At this time, a predetermined rubbery modifier was added to an end of the insulator so as to ensure a sufficient flexibility upon winding the insulated electric wire.

As a result, the insulated electric wire with partial discharge resistance is deformed by a shear yield of the entire insulator since, even though a stress is focused on the inorganic insulator, the stress is dispersed over an equatorial plane of the rubber by action of a triaxial tensile force when the stress is transferred to the rubbery modifier added to the end of the insulator, and such shear deformation is accompanied with a shear deformation of the entire matrix since one rubber molecule is connected to another rubber molecules. Therefore, the insulated electric wire with partial discharge resistance has an enhanced flexibility since it absorbs more energy while transmitting an energy for breaking an insulated electric wire to the inside of an insulator matrix.

SYNTHETIC EXAMPLE 1

6.44 kg of ethylene glycol, 21.79 kg of tris-2-hydroxyethyl-isocyaniurate (hereinafter, referred to as "THEIC"), 26.97 kg of dimethyl terephtalate (hereinafter, referred to as "DMT") and 0.09 kg of tetrabutyl titanate (hereinafter, referred to as "TBT") were respectively added to a 200 l reaction bath equipped with a stirrer, a heater and a condenser, and then the resultant mixture was gradually heated to 200° C. for 18 hours to obtain approximately 8 kg of methyl alcohol as a by-product, thereby to synthesize a heat-resistant insulated polyester resin having a hydroxyl group at its end. Then, 20 kg of metacresol was added and slowly cooled to 100° C., and then 2 kg of carboxyl terminated butadieneacrylonitrile (CTBN) having an acronitrile content of 18% by weight and a carboxyl content of 29% by weight was added and heated to 180° C. for 3 hours to deform the resin. Subsequently, xylene, TBT and a small amount of phenol resin were added to obtain an insulating paint (insulating paint 1) for manufacturing an insulator of the insulated electric wire with partial discharge resistance according to the present invention.

SYNTHETIC EXAMPLE 2

6.44 kg of ethylene glycol, 21.79 kg of THEIC, 26.97 kg of DMT and 0.09 kg of TBT were respectively added to the same reaction bath as in Synthetic example 1, and gradually heated to 200° C. for 18 hours to obtain approximately 8 kg of methyl alcohol as a by-product, thereby synthesizing a heat-resistant insulated polyester resin. Subsequently, 20 kg of metacresol, xylene, TBT and a small amount of phenol resin were added to obtain an insulating polyester paint (insulating paint 2) for manufacturing an insulator of the insulated electric wire with partial discharge resistance according to the present invention.

SYNTHETIC EXAMPLE 3

22.5 kg of trimellitic anhydride (hereinafter, referred to as "TMA"), 11.5 kg of diaminodiphenyl methane (hereinafter, referred to as "MDA"), 1 kg of 2-methyl-1,3-propanediol, 19 kg of THEIC, 14 kg of DMT and 20 kg of MDA were respectively added to the same reaction bath as in Synthetic example 1 and heated to 200° C. to evaporate off water and methanol, and then a polyesterimide resin was manufactured. Subsequently, 4 kg of CTBN having an acronitrile content of 18% by weight and a carboxyl content of 29% by weight was added and heated to 180° C. for 3 hours to deform the resin, thereby producing an insulating paint of a modified polyesterimide resin (insulating paint 3).

SYNTHETIC EXAMPLE 4

22.5 kg of TMA, 11.5 kg of MDA, 1 kg of 2-methyl-1,3-propanediol, 19 kg of THEIC, 14 kg of DMT and 20 kg of MDA were added to the same reaction bath as in Synthetic example 1 and heated to 200° C. to evaporate off water and methanol, and then a polyesterimide resin was manufactured. Subsequently, metacresol and xylene were added to obtain an insulating polyesterimide paint (insulating paint 4).

SYNTHETIC EXAMPLE 5

26.3 kg of 4,4-diphenylmethane diisocyanate (hereinafter, referred to as "MDI"), 19.2 kg of TMA and 90 kg of N-methylpyrolidone (hereinafter, referred to as "NMP") were respectively added to the same reaction bath as in Synthetic example 1 and slowly heated from a room temperature to 150° C. to remove off carbon dioxide as a by-product. Subsequently, 2 kg of CTBN having an acronitrile content of 18% by weight and a carboxyl content of 29% by weight was added to the reaction bath and further heated to 140° C. for 1 hour to deform the resultant resin, thereby producing an insulating paint of a modified polyesterimide resin (insulating paint 5).

SYNTHETIC EXAMPLE 6

26.3 kg of MDI, 19.2 kg of TMA and 90 kg of NMP were added to the same reaction bath as in Synthetic example 1 and slowly heated from a room temperature to 150° C. to remove off carbon dioxide as a by-product, and then slowly cooled to obtain an insulating polyamideimide paint (insulating paint 6).

By using the insulated film materials classified into Embodiments 1 to 8 and Comparative examples 1 to 5 as listed in the following Table 1, bare copper wires were repeatedly coated 12 times with the insulating paints 1 to 6, manufactured according to Synthetic examples 1 to 6 as described above, using a dice. At this time, the insulated wires were manufactured using a 5 m-long vertical oven as a drying oven. There is no thickness ratio between layers if the bare copper wire was coated once with the insulating paint, and a thickness ratio between a first layer and a second layer (thickness of first layer/thickness of second layer) preferably ranges from 0.4 to 2.5 if the bare copper wire was coated twice with the insulating paint. But, the insulated wires were manufactured, respectively, with the thickness ratios being set to 1 in Embodiments 1 to 8 and Comparative examples 1 to 5 as listed in the following Table 1.

FIG. 1 is a cross-sectional view showing an insulated electric wire according to one embodiment of the present invention.

Referring to FIG. 1, a multi-layered insulated film including a first layer 101 surrounding a conductor wire 100; and a second layer 102 surrounding the first layer 101 was made of the materials as described above, and a third film layer (Not shown) surrounding the second layer 102 may be further provided thereto, if necessary.

TABLE 1

| | | Insulated film materials (Parts by weight) | | Insulator diameter | Total diameter | Film thickness |
|---|---|---|---|---|---|---|
| | | First layer | Second layer | (mm) | (mm) | (mm) |
| Embodiments | 1 | Insulating paint 1 (100) + Silica (20) | — | 1.500 | 1.572 | 0.036 |
| | 2 | Insulating paint 1 (100) + Silica (50) | — | 1.500 | 1.570 | 0.035 |
| | 3 | Insulating paint 3 (100) + Silica (20) | — | 1.500 | 1.572 | 0.036 |
| | 4 | Insulating paint 5 (100) + Silica (20) | — | 1.500 | 1.572 | 0.036 |
| | 5 | Insulating paint 2 | Insulating paint 1 (100) + Silica (20) | 1.501 | 1.573 | 0.036 |
| | 6 | Insulating paint 2 | Insulating paint 5 (100) + Silica (20) | 1.500 | 1.572 | 0.036 |
| | 7 | Insulating paint 6 | Insulating paint 5 (100) + Silica (20) | 1.500 | 1.572 | 0.036 |
| | 8 | Insulating paint 6 | Insulating paint 5 (100) + Silica (20) | 1.500 | 1.572 | 0.036 |
| Comparative examples | 1 | Insulating paint 2 (100) + Silica (20) | | 1.501 | 1.573 | 0.036 |
| | 2 | Insulating paint 4 (100) + Silica (20) | | 1.500 | 1.572 | 0.036 |
| | 3 | Insulating paint 6 (100) + Silica (20) | | 1.500 | 1.572 | 0.036 |
| | 4 | Insulating paint 2 | Insulating paint 2 (100) + Silica (20) | 1.500 | 1.572 | 0.036 |
| | 5 | Insulating paint 2 | Insulating paint 6 (100) + Silica (20) | 1.500 | 1.572 | 0.036 |

Films of the insulated electric wires were formed of each of the insulated materials as listed in Table 1, and then evaluated or measured for appearance, film defect, dielectric breakdown voltage and VT property, as follows. Tile results are listed in the following Table 2.

Evaluation of Film Defect

The film defect was measured according to a KSC-3506 method. The film defect is an evaluation factor used as a measure of film pliability.

Measurement of Dielectric Breakdown Voltage

The dielectric breakdown voltage was measured according to a KSC-3506 method.

Measurement of VT Property

The VT property is represented by a measured time when a dielectric breakdown is initiated, that is when a leakage current exceeds 5 mA if the film of the insulated electric wire is twisted into a shape of a test sample used for measuring the dielectric breakdown voltage according to a KSC-3506 method, and then subject to a sine wave of 1.5 kV at 10 kHz. VT values in a winding elongated by 20% and VT values in a general winding were measured, respectively, and compared to each other to determine a reduced level of the property.

TABLE 2

| | | | Film defect | | Dielectric breakdown voltage (kV) | | VT property (Hr) | |
|---|---|---|---|---|---|---|---|---|
| | | Appearance | Normal | 20% Elongation | Normal | 20% Elongation | Normal | 20% Elongation |
| Embodiments | 1 | Transparent | 1 d | 1 d | 15 | 14 | 60 | 30 |
| | 2 | Transparent | 1 d | 1 d | 17 | 16 | 80 | 42 |
| | 3 | Transparent | 1 d | 1 d | 14.5 | 13.5 | 50 | 30 |
| | 4 | Transparent | 1 d | 1 d | 14 | 14 | 60 | 45 |
| | 5 | Transparent | 1 d | 1 d | 13 | 12 | 45 | 28 |
| | 6 | Transparent | 1 d | 1 d | 15 | 12 | 50 | 35 |
| | 7 | Transparent | 1 d | 1 d | 14 | 14 | 50 | 45 |
| | 8 | Transparent | 1 d | 1 d | 14 | 14 | 50 | 45 |
| Comparative examples | 1 | Transparent | 2 d | 4 d | 15 | 7 | 60 | 11 |
| | 2 | Transparent | 2 d | 4 d | 14 | 6.5 | 50 | 10 |
| | 3 | Transparent | 2 d | 3 d | 14 | 7 | 60 | 20 |
| | 4 | Transparent | 1 d | 3 d | 15 | 6 | 50 | 5 |
| | 5 | Transparent | 1 d | 3 d | 15 | 7 | 45 | 7 |

As seen in Table 2, it was revealed that there is no change between the measured film defects of the normal wire and the wire elongated by 20% in all Embodiments 1 to 8, while the film defects are changed as much as at least one grade in the wire elongated by 20% when-compared to the normal wire in all Comparative examples 1 to 5. Also, it was confirmed that there is no change between the dielectric breakdown voltages of the normal wires in the embodiments and the comparative examples, but the dielectric breakdown voltage is maintained without exhibiting slight differences between the measured values of the normal wires and the wire undergoing an external stress, that is the wire elongated by 20% in all Embodiments 1 to 8, while the dielectric breakdown voltage is decreased by about 50% in all Comparative examples 1 to 5. From the results, it was seen that the film properties are damaged when the content of the inorganic oxide approaches 100%. It might be confirmed that the VT property is decreased up to 50% (Embodiment 1) in all Embodiments 1 to 8, while the VT property is decreased to at least 66.7% (Comparative example 3) in all Comparative examples 1 to 5. Therefore, the technical effects of the present invention may be clearly confirmed from the above-mentioned facts.

As described above, the best embodiments of the present invention are disclosed. Therefore, the specific terms are used in the specification and appended claims, but it should be understood that the description proposed herein is just a preferable example for the purpose of illustrations only, not intended to limit the scope of the invention.

APPLICABILITY TO THE INDUSTRY

As described abode, the insulated electric wire with partial discharge resistance of the present invention may be useful to prevent occurrence of cracks caused by winding of an insulated electric wire since the insulated electric wire has a sufficient partial discharge resistance and also enhances sufficient physical properties such as flexibility, pliability, bendability, elongation, etc. to maintain an electrically insulating property intactly by dispersing a stress, applied from an external force, by means of a rubber component attached to an end thereof.

What is claimed is:

1. An insulated electric wire with partial discharge resistance, comprising:

a first layer manufactured using a composition comprising an insulating base resin constituting a basic material of an insulated electric wire, and a rubbery modifier included at a content of 0.1 to 30 parts by weight on the basis of 100 parts by weight of the insulating base resin to improve flexibility of an insulated electric wire; and a second layer manufactured using the composition comprising an insulating base resin constituting a basic material of an insulated electric wire, an inorganic insulator included at a content of 5 to 40 parts by weight on the basis of 100 parts by weight of the insulating base resin, and a rubbery modifier included at a content of 0.1 to 30 parts by weight on the basis of 100 parts by weight of the insulating base resin to improve flexibility of an insulated electric wire, wherein the inorganic insulator is metal nitride having a diameter of 5 to 900 nm, which is a single material or a mixture of at least two materials selected from the group consisting of silicon (Si), titanium (Ti), zirconium (Zr) and cobalt (Co).

2. The insulated electric wire with partial discharge resistance according to claim 1, wherein the insulating base resin is a single material or a mixture of at least two materials selected from the group consisting of polyester, polyesterimide, polyamideimide, polyimide and copolymers thereof.

3. The insulated electric wire with partial discharge resistance according to claim 1, wherein the rubbery modifier material is a single material or a mixture of at least two materials selected from the group consisting of carboxyl-terminated butadieneacrylonitrile (CTBN) rubber, amine-terminated butadieneacrylonitrile (ATBN) rubber and copolymers thereof.

4. The insulated electric wire with partial discharge resistance according to claim 1, wherein a thickness ratio between the first layer and the second layer preferably ranges from 0.4 to 2.5.

5. An insulated electric wire with partial discharge resistance, comprising:

a first layer manufactured using a composition comprising an insulating base resin constituting a basic material of an insulated electric wire; and a second layer manufactured using the composition comprising an insulating base resin constituting a basic material of an insulated electric wire, an inorganic insulator included at a content of 5 to 40 parts by weight on the basis of 100 parts by weight of the insulating base resin, and a rubbery modifier included at a content of 0.1 to 30 parts by weight on the basis of 100 parts by weight of the insulating base resin to improve flexibility of an insulated electric wire, wherein the inorganic insulator is metal nitride having a diameter of 5 to 900 nm, which is a single material or a mixture of at least two materials selected from the group consisting of silicon (Si), titanium (Ti), zirconium (Zr) and cobalt (Co).

6. The insulated electric wire with partial discharge resistance according to claim 5, wherein the insulating base resin is a single material or a mixture of at least two materials selected from the group consisting of polyester, polyesterimide, polyamideimide, polyimide and copolymers thereof.

7. The insulated electric wire with partial discharge resistance according to claim 5, wherein the rubber modifier material is a single material or a mixture of at least two materials selected from the group consisting of carboxyl-terminated butadieneacrylonitrile (CTBN) rubber, amine-terminated butadieneacrylonitrile (ATBN) rubber and copolymers thereof.

8. The insulated electric wire with partial discharge resistance according to claim 5, wherein a thickness ratio between the first layer and the second layer preferably ranges from 0.4 to 2.5.

* * * * *